US005666027A

United States Patent [19]

Jaspers

[11] Patent Number: 5,666,027

[45] Date of Patent: Sep. 9, 1997

[54] LOW-PRESSURE MERCURY VAPOUR DISCHARGE LAMP AND METHOD OF MANUFACTURING SAME

[75] Inventor: Johannes M. M. Jaspers, Roosendaal, Netherlands

[73] Assignee: U.S. Philips Corporation, New York, N.Y.

[21] Appl. No.: 362,039

[22] Filed: Dec. 22, 1994

[30] Foreign Application Priority Data

Dec. 24, 1993 [BE] Belgium ..... 09301463

[51] Int. Cl.[6] ..... H01J 61/42; H01J 61/35

[52] U.S. Cl. ..... 313/635; 313/489; 445/58

[58] Field of Search ..... 313/489, 635; 445/58

[56] References Cited

U.S. PATENT DOCUMENTS

| | | | |
|---|---|---|---|
| 4,547,700 | 10/1985 | Landry | 313/489 |
| 4,607,191 | 8/1986 | Flaherty | 313/489 |
| 4,670,688 | 6/1987 | Sigai et al. | 313/489 |
| 5,539,277 | 7/1996 | Jansma | 313/635 |

FOREIGN PATENT DOCUMENTS

| | | |
|---|---|---|
| 0507533 | 10/1992 | European Pat. Off. . |
| 3201606 | 9/1982 | Germany . |
| 2091936 | 8/1992 | United Kingdom . |

*Primary Examiner*—Nimeshkumar Patel

*Attorney, Agent, or Firm*—Brian J. Wieghaus; Walter M. Egbert, III

[57] ABSTRACT

A low-pressure mercury vapor discharge lamp with a tubular discharge vessel (1) with an internal diameter D. The discharge vessel (1) encloses a discharge space (3), which comprises mercury and a rare gas, in a gastight manner. Electrodes (5A, 5B) are arranged in end portions (4A, 4B) of this discharge space. The discharge vessel (1) has a luminescent layer (10) which supports a protective layer (11) comprising a metal oxide at an inner surface (9). In the lamp according to the invention, at least 75% by weight of the metal oxide is present in total in the end portions (4A, 4B), said end portions (4A, 4B) each extending up to a distance beyond the electrodes (5A, 5B) which is three times the internal diameter of the discharge vessel (1). The lamp has a comparatively low luminous decrement and can be manufactured comparatively efficiently. The lamp may be manufactured comparatively efficiently in that the suspension is sprayed in the direction of the luminescent layer from a position outside the discharge vessel under construction, opposite each end portion.

12 Claims, 2 Drawing Sheets

32B
24B
30
29
20
24A
32A
40A
40B
31

LOW-PRESSURE MERCURY VAPOUR DISCHARGE LAMP AND METHOD OF MANUFACTURING SAME

BACKGROUND OF THE INVENTION

The invention relates to a low-pressure mercury vapour discharge lamp provided with a tubular discharge vessel with an internal diameter D which encloses a discharge space, which contains mercury and a rare gas, in a gaslight manner and in whose end portions electrodes are arranged, said discharge vessel being provided at an inner surface with a luminescent layer which supports a protective layer comprising a metal oxide.

The invention also relates to a method of manufacturing the low-pressure mercury vapour discharge lamp whereby the discharge vessel under construction is provided with the luminescent layer at the inner surface, after which a suspension comprising a metal oxide is provided on the luminescent layer.

Such a lamp is known from DE 32 01 606 C1. The known lamp has a protective layer of aluminium oxide over a luminescent layer of halophosphates. Owing to the presence of the protective layer, the light output of the lamp decreases less strongly in the operating period after 100 hours of operation than is the case with a lamp without protective layer.

The luminescent layer is provided in the known lamp in that a suspension of luminescent material is caused to flow from an end over the inner surface of the discharge vessel until it issues from the other end of the discharge vessel. The provision of the luminescent layer in the form of a suspension was found to be a convenient method which is widely used. The protective layer is provided on the luminescent layer in an analogous manner. The protective layer is not provided, however, until after the luminescent layer has been sintered, i.e. heated for some time so as to drive out from the layer the auxiliary substances still present in the layer. Sintering of the luminescent layer before the protective layer is provided thereon is necessary in order to avoid luminescent material being washed away when the metal oxide suspension flows over the surface thereof. After the provision of the protective layer, however, a second sintering operation is necessary for removing the auxiliary substances from this layer also. The repetition of this comparatively time-consuming operation renders the manufacture of the known lamp comparatively inefficient compared with that of a lamp without protective layer.

SUMMARY OF THE INVENTION

It is an object of the invention to provide a low-pressure mercury vapour discharge lamp of the kind described in the opening paragraph which can be manufactured in a comparatively efficient manner and whose reduction in light output during lamp life is nevertheless comparatively small.

According to the invention, the lamp is for this purpose characterized in that at least 75% by weight of the metal oxide in total is present in the end portions, said end portions each extending up to a distance beyond the electrodes which is three times the internal diameter D of the discharge vessel. The protective layer comprises, for example, aluminium oxide, yttrium oxide, or terbium oxide. It was surprisingly found that, although at least substantially all the metal oxide is present in the end portions, the reduction in light output occurring during lamp life has nevertheless become much smaller. In particular, a strong reduction in the initial luminous decrement is realised by the measure according to the invention in lamps having a wall load of at least 500 W/m$^2$. Initial luminous decrement is here understood to mean the reduction in the light output in the operating period from shortly after the start of lamp life, for example a few burnings hours, up to 100 burning hours. The wall load is defined here as the power which is dissipated in the discharge arc extending between the electrodes during nominal operation divided by the inner surface area between the electrodes. In the lamp according to the invention, the portions to be coated with a metal oxide are directly accessible to a sufficient degree from a position outside the discharge vessel. This renders it possible in a simple manner to provide the protective layer in the form of a suspension without this suspension flowing through an end portion over the luminescent layer. The luminescent layer may thus be provided as a suspension of luminescent material without luminescent material being washed away during the provision of the metal oxide suspension. Sintering of the luminescent layer before the provision of the protective layer is unnecessary then. It suffices to sinter the luminescent layer jointly with the protective layer.

A practical embodiment of the lamp according to the invention is characterized in that the protective layer covers the luminescent layer entirely up to a distance beyond the electrodes which is at least equal to the internal diameter D. In this embodiment, the luminescent layer has a very good adhesion to the inner surface at the end portions. In the case of bad adhesion, luminescent material may become detached in the end portions during further manufacturing steps of the lamp, such as during the mounting of the electrodes.

In a lamp with a comparatively thick protective layer in the end potions, radiation generated in the discharge space is absorbed comparatively strongly in said portions compared with a central portion of the discharge vessel situated between the end portions. If the protective layer ends abruptly, the end portions of the discharge vessel may as a result stand out from the central portion as comparatively dark zones of the discharge vessel during lamp operation. Although this is not a disadvantage when the lamp is screened by a luminaire, it may be undesirable when the lamp is directly visible. An attractive embodiment of the lamp according to the invention is characterized in that the layer thickness of the protective layer decreases gradually in the end portions in a direction towards the central potion. Owing to the gradual change in layer thickness, a difference in brightness between the end potions on the one hand and the central potion on the other hand is evened out. The end potions thus do not stand out distinctly against the central portion.

A method of manufacturing a low-pressure mercury vapour discharge lamp according to the invention, whereby the discharge vessel is provided with a luminescent layer at its inner surface, after which a suspension comprising metal oxide is provided on the luminescent layer, is characterized according to the invention in that the suspension comprising the metal oxide is provided on the luminescent layer in that it is sprayed in the direction of the luminescent layer from a position outside the discharge vessel under construction opposite each end portion. The suspension is provided directly on the surfaces to be coated in that the suspension comprising metal oxide is sprayed, whereby flowing of this suspension over the surface of the luminescent layer and washing away of luminescent layer thereby can be avoided. In the method according to the invention, sintering of a luminescent layer provided as a suspension is not necessary before the protective layer is provided. It is sufficient to sinter the luminescent layer and the protective layer jointly.

Spraying of the suspension with the metal oxide can take place quickly, for example in a few tenths of a second, so that the production process need not be delayed by this operation.

The profile of the protective layer formed by spraying depends on the choice of the atomizer with which the metal oxide suspension is sprayed and the pressure with which spraying takes place. A protective layer may be obtained, for example, which has a substantially constant thickness in the end potions and which ends abruptly between each end potion and the central portion. Alternatively, for example, a protective layer may be obtained whose thickness decreases gradually in the end portions towards the central potion.

The discharge vessel is, for example, a single tube which is bent, for example, in the shape of a U or in a hook-shape. In an embodiment, the discharge vessel is composed of two or more tube parts, adjoining tube parts being interconnected by a channel each time.

BRIEF DESCRIPTION OF THE DRAWINGS

These and other aspects of the invention are explained in more detail with reference to the drawing, in which.

DETAILED DESCRIPTION OF THE PREFERRED EMBODIMENTS.

Figure 1:
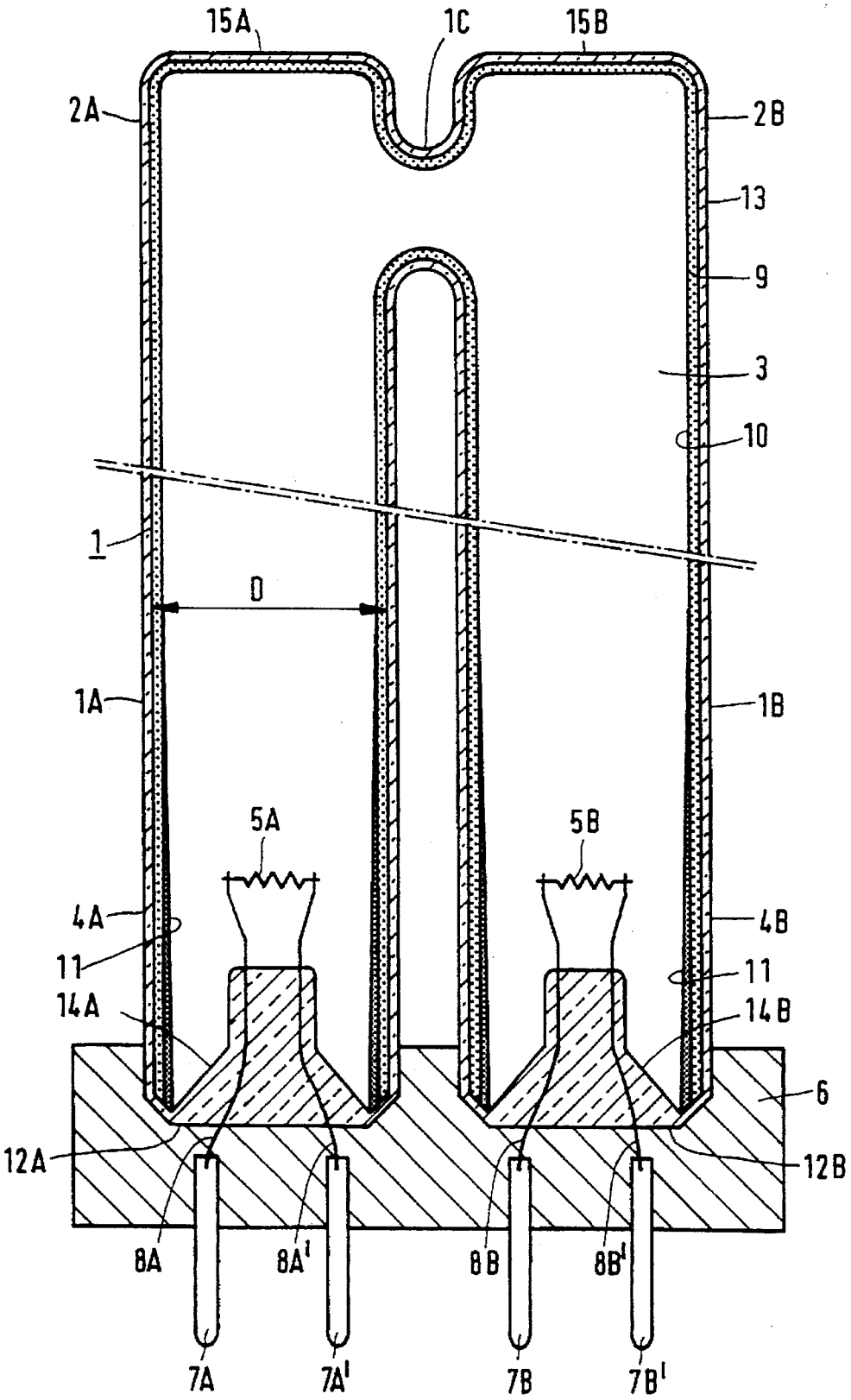
FIG. 1 shows an embodiment of the low-pressure mercury vapour discharge lamp according to the invention in longitudinal section.

FIG. 1 shows a low-pressure mercury vapour discharge lamp provided with a tubular glass discharge vessel 1 with an internal diameter of 1 cm. In the embodiment shown, the discharge vessel 1 comprises two interconnected parallel tube parts 1A, 1B each with a length of 20 cm, radially interconnected at ends 2A, 2B by a channel 1C. The discharge vessel 1 encloses a discharge space 3 in a gastight manner, which space comprises mercury and a rare gas, in this case argon. The end portions 4A, 4B of the discharge vessel 1 have respective lead-through portions 14A, 14B supporting electrodes 5A, 5B arranged in the discharge space 3, while current supply conductors 8A, 8A', 8B, 8B' are passed from outside the discharge vessel 1 to the electrodes 5A, 5B through said lead-through portions. The end potions 4A, 4B are fixed in a synthetic-resin lamp cap 5 which supports contact pins 7A, 7A', 7B, 7B' which are electrically connected to the current supply conductors 8A, 8A', 8B, 8B'. The electrodes 5A, 5B are arranged at a distance of 1.8 cm from the ends 12A, 12B. The discharge vessel 1 is provided at an inner surface 9 with a luminescent layer 10 which supports a protective layer 11 comprising a metal oxide, in this case aluminium oxide of the Alon-C type. The luminescent layer of the lamp shown has a coating weight of 2.5 mg/cm$^2$ and comprises 40% by weight cerium-magnesium aluminate activated by trivalent terbium (CAT), 27% by weight barium-magnesium aluminate activated by bivalent europium (BAM), and 33% by weight yttrium oxide activated by trivalent europium (YOX). The wall load in the lamp is 700 W/m$^2$.

The protective layer 11 comprises a total of 5 mg metal oxide. At least 75% by weight thereof is present jointly in the end portions 4A, 4B, the end portions 4A, 4B each extending beyond the electrodes 5A, 5B up to a distance three times the internal diameter D of the discharge vessel 1. Here approximately 80% by weight is present in the two end potions 4A, 4B, the end portions 4A, 4B extending over a length of 5 cm each.

25 lamps according to the invention were compared with 25 lamps not according to the invention, which are without protective layers but correspond to the lamp according to the invention in other respects, in an endurance test. The lamps not according to the invention were found to show a reduction in light output of 11% on average in the operating period between 100 and 2000 burning hours. A reduction in the light output of 5.5% on average was measured in the lamps according to the invention in this operating period.

The initial luminous decrement was also measured in the operating period from 2 burning hours to 100 burning hours. It was found that lamps according to the invention as well as those not according to the invention have stabilized sufficiently for enabling a reproducible measurement after approximately two burning hours. The initial luminous decrement in a group of 30 lamps not according to the invention was 8.5% on average. In a group of 30 lamps according to the invention the initial luminous decrement was no more than 2.7% on average.

The protective layer 11 covers the luminescent layer 10 entirely up to a distance equal to the tube diameter D beyond the electrodes 5A, 5B. The adhesion of the luminescent material to the wall in this region was measured in that air was blown against the coated luminescent layer 10. The luminescent layer 10 in the said region was found to resist a 5 to 10 times higher air pressure than an incompletely covered or uncovered luminescent layer.

The layer thickness of the protective layer 11 decreases gradually in the end portions 4A, 4B in a direction to a central portion 13 situated between the end portions 4A, 4B. In the present case, the protective layer 11 has layer thicknesses of 3 μm, 1 μm, and 0.2 μm at distances of 1, 3 and 5 cm, respectively. The layer thickness is negligibly small at a distance of 10 cm from the ends 12A, 12B. During operation of this embodiment of the lamp according to the invention, the end portions 4A, 4B were found not to differ appreciably in brightness from the central potion 13.

In another embodiment different from the one shown, the discharge vessel comprises more than two interconnected tube parts. In a modification of this embodiment, the discharge vessel comprises four tube parts, the first and the fourth tube part being connected to respective ends of a second and a third tube part at ends facing away from the electrodes. In this modification, the second and the third tube parts are interconnected through a further channel at ends opposed to the ends where said tube parts are connected to the first and second tube parts.

The embodiment of the lamp shown was manufactured as follows (see FIGS. 2A to 2D). Components in FIGS. 2A to 2D corresponding to those in FIG. 1 have reference numerals which are 20 higher. A lime-glass tube 20 (FIG. 2A) with a length of approximately 40 cm and an internal diameter of 1 cm was provided with a layer of suspended luminescent material 30 in that a suspension of luminescent materials was made to flow over the inner surface 29 of this tube. Then the tube 20 was moved by a transport member, here a toothed belt (not shown), into the position indicated in FIG. 2B. In this position, a first end potion 24A of the tube 20 is situated opposite an atomizer 40A and a second, opposed end portion 24B opposite an evacuation member (not shown). A suspension of metal oxide particles was sprayed in the direction of the end portion 24A by means of the atomizer 40A for a short period, in this case a few tenths of a second. The atomized suspension deposited itself on the surface of the layer of suspended luminescent material 30 during this. The evacuation member, which creates an underpressure in the tube 20, prevented the atomized suspension from spreading outside the tube 20 and promoted the distribution of the metal oxide suspension over the end portion 24A.

Figures 2A, 2B, 2C, 2D:
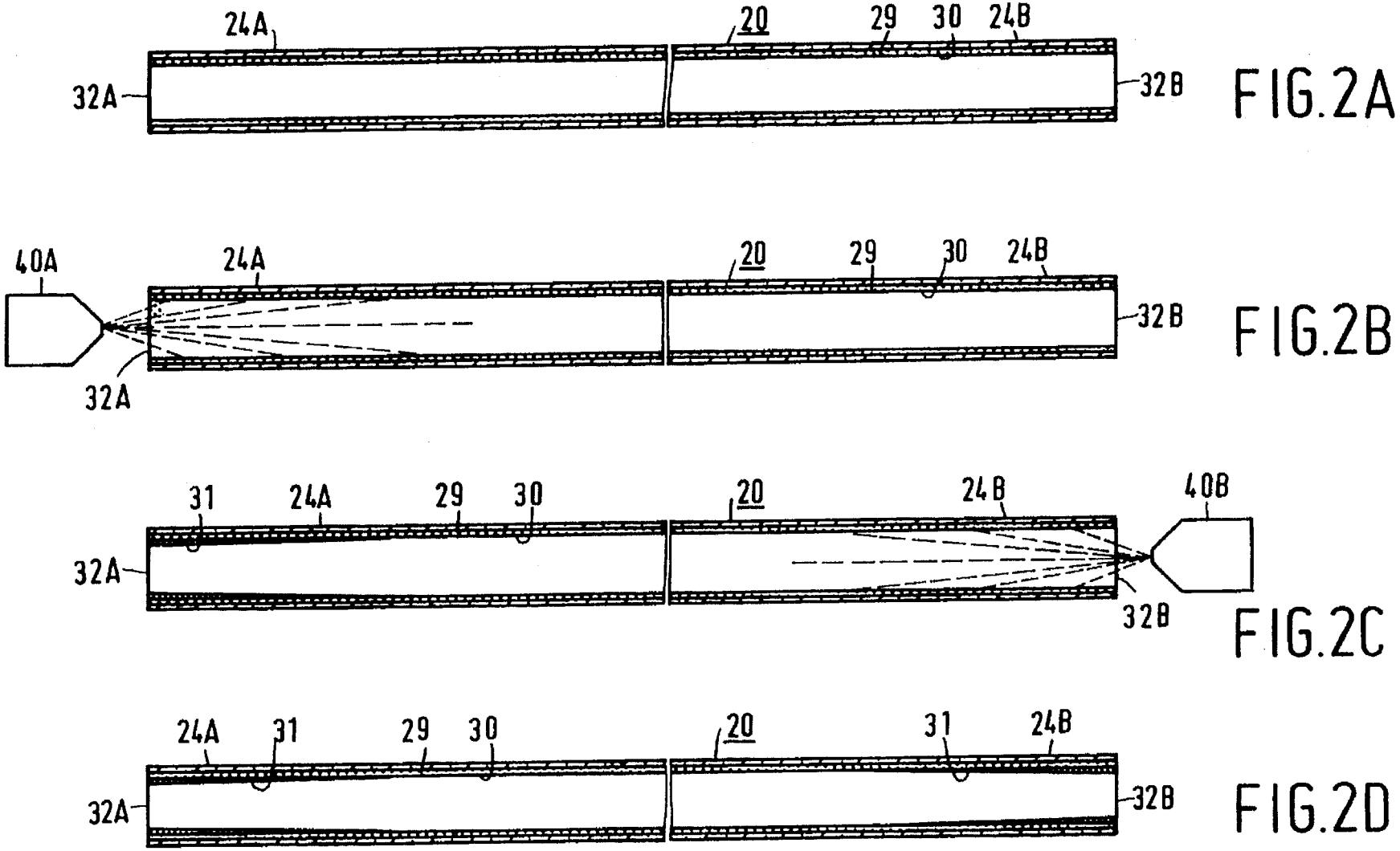
FIGS. 2A to 2D show a manufacturing step in an embodiment of a method according to the invention.

After a further transport step, the tube 20 occupied the position shown in FIG. 2C in which the second end portion 24B is arranged opposite a further atomizer 40B and the first end portion 24A opposite a further evacuation member (not shown). After the second end portion 24B was provided with the metal oxide suspension 31 by the further atomizer 40B, the tube 20 shown in FIG. 2D was obtained. The tube 20 thus obtained was subsequently sintered so as to drive auxiliary substances from the luminescent layer 30 and the protective layer 31. The tube 20 was then divided into the two tube parts 1A, 1B (see FIG. 1), each with a new end 15A, 15B closed through constriction in that the tube 20 was softened through heating in a location centrally between the ends and the ends of the tube were pulled apart. Then the tube parts 1A, 1B were interconnected radially through the channel 1C at end portions adjoining the newly formed ends 15A, 15B. First an overpressure was generated in each tube part. 1A, 1B and the walls of the tube parts were softened through heating in the location of the channel 1C to be formed. An open gorge was created thereby. The channel 1C was subsequently formed in that the gorges were fused together. The end portions 4A, 4B were then provided with the respective lead-through potions 14A, 14B which support the electrodes 5A, 5B and through which the current supply conductors 8A, 8A', 8B, 8B' extend to the electrodes 5A, 5B. The discharge vessel 1 thus obtained was subsequently evacuated and provided with the mercury and argon filling. Then the discharge vessel 1 was fastened in the lamp cap 6 with its end portions 4A, 4B, such that the contact pins 7A, 7A', 7B, 7B' were connected to the current supply conductors 8A, 8A', 8B, 8B'.

I claim:

1. A low-pressure mercury vapour discharge lamp, comprising:

a tubular discharge vessel enclosing a discharge space in a gastight manner, said discharge vessel having end portions and an internal surface with an internal diameter D, mercury and a rare gas within said discharge space, discharge electrodes arranged in said end portions a luminescent layer on an inner surface, and a protective layer comprising a metal oxide on said luminescent layer, at least 75% by weight of the metal oxide in total being present in the end portions, said end portions each extending up to a distance beyond the electrodes which is three times the internal diameter D of the discharge vessel.

2. A low-pressure mercury vapour discharge lamp as claimed in claim 1, characterized in that the protective layer covers the luminescent layer entirely up to a distance beyond the electrodes which is at least equal to the internal diameter D.

3. A low-pressure mercury vapour discharge lamp as claimed in claim 1 or 2, characterized in that the layer thickness of the protective layer decreases gradually in the end portions in a direction towards a central portion situated between the end portions.

4. A method of manufacturing a low-pressure mercury vapour discharge lamp as claimed in claim 3, in which the discharge vessel under construction is provided with the luminescent layer at the inner surface, after which a suspension comprising a metal oxide is provided on the luminescent layer, characterized in that the suspension comprising the metal oxide is provided on the luminescent layer in that it is sprayed in the direction of the luminescent layer from a position outside the discharge vessel under construction opposite each end portion.

5. A method of manufacturing a low-pressure mercury vapour discharge lamp as claimed in claim 2, in which the discharge vessel under construction is provided with the luminescent layer at the inner surface, after which a suspension comprising a metal oxide is provided on the luminescent layer, characterized in that the suspension comprising the metal oxide is provided on the luminescent layer in that it is sprayed in the direction of the luminescent layer from a position outside the discharge vessel under construction opposite each end portion.

6. A method of manufacturing a low-pressure mercury vapour discharge lamp as claimed in claim 1, in which the discharge vessel under construction is provided with the luminescent layer at the inner surface, after which a suspension comprising a metal oxide is provided on the luminescent layer, characterized in that the suspension comprising the metal oxide is provided on the luminescent layer in that it is sprayed in the direction of the luminescent layer from a position outside the discharge vessel under construction opposite each end portion.

7. A low pressure mercury vapor discharge lamp according to claim 1, wherein said lamp has a wall loading of at least 500 $W/m^2$.

8. A low pressure gas discharge lamp, comprising:

a) a discharge vessel having first and second tube portions and means for interconnecting said tube portions in a gas tight manner so that said tube portions communicate with each other, said tube portions each having an inner surface with an inner diameter and a sealed end portion;

b) a pair of discharge electrodes each disposed adjacent a respective sealed end portion;

c) a discharge sustaining filling within said discharge vessel for maintaining a gas discharge during lamp operation between said discharge electrodes and through said means for interconnecting;

d) a luminescent layer disposed on said inner surface; and e) a layer comprising a metal oxide on said luminescent layer, at least 75% by weight of the metal oxide in total being present in the sealed end portions, the sealed end portions each extending up to a distance beyond the electrodes of three times the internal diameter of the discharge vessel, said lamp having a wall loading during lamp operation of at least 500 $W/m^2$.

9. A gas discharge lamp according to claim 8, wherein said means for interconnecting comprises a tubular bridge between said first and second tube portions adjacent respective ends of said first and second tube portions remote from said sealed end portions.

10. A gas discharge lamp according to claim 8, wherein said means for interconnecting includes additional tube portions each having an inner surface carrying said luminescent layer.

11. A low-pressure mercury vapour discharge lamp as claim in claim 8, characterized in that the protective layer covers the luminescent layer entirely up to a distance beyond the electrodes which is at least equal to the internal diameter.

12. A low-pressure mercury vapour discharge lamp as claimed in claim 8, characterized in that the layer thickness of the protective layer decreases gradually in the end portions in a direction towards a central portion situated between the sealed end portions.

* * * * *